US006152151A

United States Patent [19]

Bolden et al.

[11] Patent Number: 6,152,151

[45] Date of Patent: Nov. 28, 2000

[54] DEVICE AND METHOD FOR LIQUID REMOVAL FROM CARPET

[75] Inventors: Kurt E. Bolden, Cicero; Dave Sutton, Sr., Arcadia, both of Ind.

[73] Assignee: Bolden's Manufacturing, Inc., Noblesville, Ind.

[21] Appl. No.: 09/357,558

[22] Filed: Jul. 20, 1999

[51] Int. Cl.[7] ..... A47L 7/00

[52] U.S. Cl. ..... 134/21; 15/322; 15/353; 15/383; 15/422

[58] Field of Search ..... 15/320, 321, 322, 15/353, 383, 378, 422; 134/21

[56] References Cited

U.S. PATENT DOCUMENTS

| | | | |
|---|---|---|---|
| 1,240,799 | 9/1917 | Gray | 15/320 |
| 1,268,962 | 6/1918 | Gray | 15/320 X |
| 1,283,499 | 11/1918 | Gray | 15/383 X |
| 1,527,828 | 2/1925 | Barr | 15/422 X |
| 1,601,774 | 10/1926 | Scheffer | 15/422 X |
| 3,218,876 | 11/1965 | Berger . | |
| 3,683,447 | 8/1972 | Stevenson . | |
| 3,936,199 | 2/1976 | Zimmermann . | |
| 4,000,536 | 1/1977 | Nayfa et al. . | |
| 4,069,540 | 1/1978 | Zamboni | 15/320 |
| 4,145,823 | 3/1979 | Lucas . | |
| 4,210,978 | 7/1980 | Johnson et al. . | |
| 4,386,873 | 6/1983 | Messner et al. | 15/321 X |
| 4,441,229 | 4/1984 | Monson . | |
| 4,577,364 | 3/1986 | Demetriades | 15/383 X |
| 4,595,420 | 6/1986 | Williams, III et al. . | |
| 4,875,246 | 10/1989 | MacGregor . | |
| 4,989,293 | 2/1991 | Bashyam | 15/383 |
| 5,067,199 | 11/1991 | Alazet . | |
| 5,357,650 | 10/1994 | Finley . | |
| 5,485,652 | 1/1996 | Holland . | |
| 5,893,216 | 4/1999 | Smith et al. . | |

FOREIGN PATENT DOCUMENTS

| | | | |
|---|---|---|---|
| 1209341 | 10/1970 | United Kingdom | 15/320 |

*Primary Examiner*—Chris K. Moore

*Attorney, Agent, or Firm*—Woodard, Emhardt, Naughton, Moriarty & McNett

[57] ABSTRACT

The flooding device is disclosed coupled to a suction pump truck by flexible conduit. The deflooding device includes a suction chamber having a downward facing opening therein and a compression element, namely a roller, protruding therefrom. The roller has openings or other structure to allow water to exist beneath the roller while the roller is compressing the carpet nap. A propulsion system including a motor drive system attached to the roller allows the unit to be self-propelled across the carpet.

20 Claims, 7 Drawing Sheets

DEVICE AND METHOD FOR LIQUID REMOVAL FROM CARPET

BACKGROUND OF THE INVENTION

The present invention relates generally to a device and method for removing liquid from carpets, such as carpets which have been flooded. The invention relates more specifically to such a device and method utilizing a compression element in combination with suction.

The water removal from carpet is an important business; for example, fire sprinkler systems or broken plumbing can flood carpeting, requiring removal of the water in an effort to restore the carpet without having to undergo the expense of replacing the carpet. It is important to remove substantially all of the standing water so as to avoid mildew and other associated problems. Current systems commercially utilized, while providing reasonable results, require a significant number of multiple passes of the vacuum apparatus to adequately deflood the carpet. Such systems include the systems shown in U.S. Pat. No. 5,357,650 and U.S. Pat. No. 4,441,229. Other systems use suction wands alone attached to high volume suction systems located in a service truck. Other systems use weighted roller systems with a separate suction receptacle placed underneath the carpet, whereby the weighted roller is used to squeegee water towards the suction water receptacle.

The industry could benefit from a system which provides greater liquid recovery from the carpet and pad particularly such a system which removes substantially the liquid from the carpet in as few passes as possible, and ideally in a single pass. The present invention provides such a system, thereby allowing greater efficiency and lower costs as well as faster clean-up time for a given job.

SUMMARY OF THE INVENTION

The present invention provides a device and method which utilizes suction from a high volume source, typically located in a remote service truck and attached to a hose or other such conduit. This is coupled to a suction chamber which surrounds a carpet compression element. The compression element protrudes partially beneath the suction chamber through a downwardly facing opening. In one embodiment, a compression roller has perforations or other openings therein; has one or more weights above the roller to provide pressing of the roller onto the carpet; provides a motorized propulsion system to advance the device across the carpet; and/or other features and elements as claimed below. It is noted that such features may or may not be included in a particular embodiment of the invention as summarized herein, such invention being set forth by the claims.

An object of the present invention is to provide and improve device and method for removal of liquid from carpet.

DESCRIPTION OF THE PREFERRED EMBODIMENTS

Figure 1A:
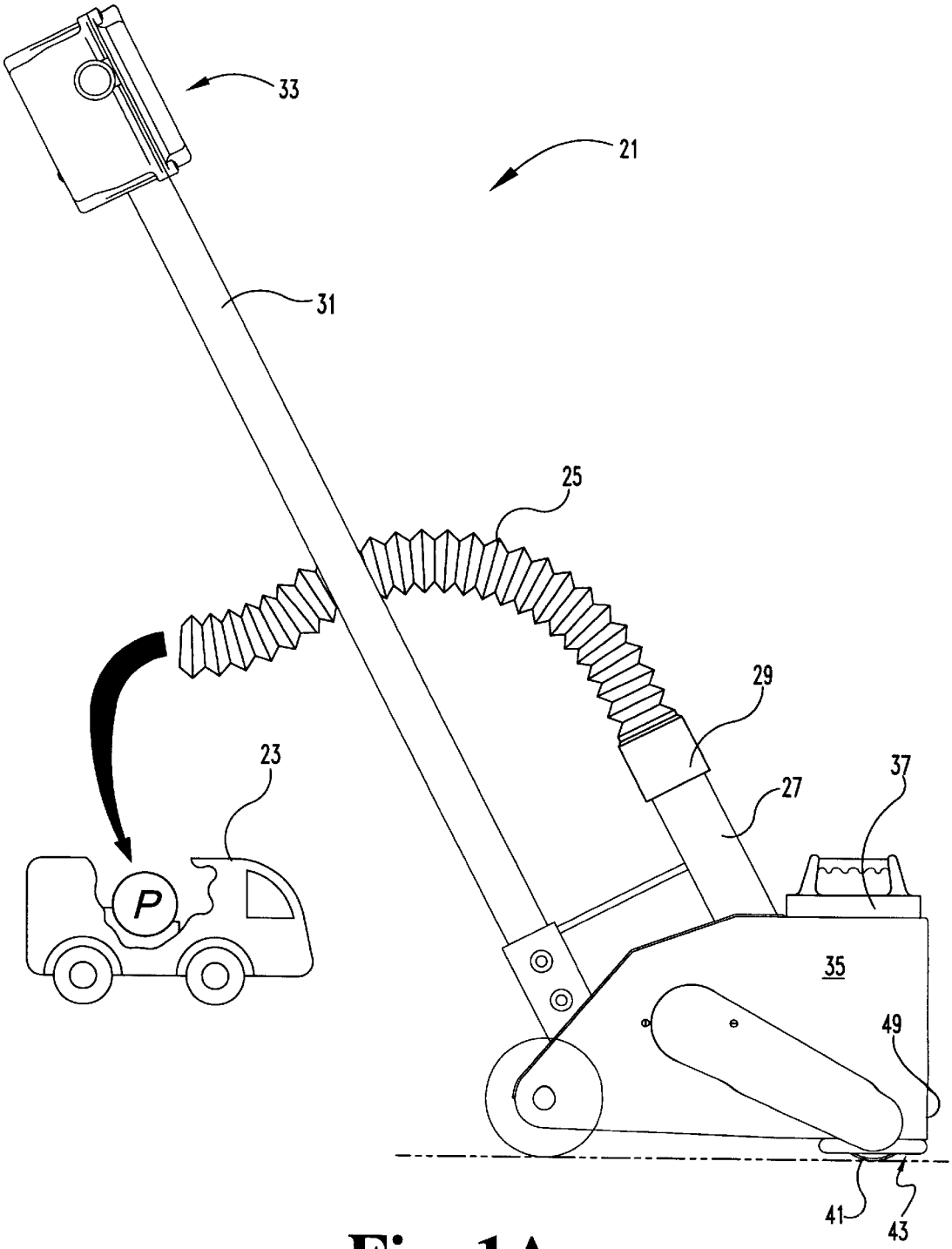
FIG. 1A is a side view of one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device and method, and further applications of the principles of the invention as illustrated therein are herein contemplated as would normally occur to one skilled in the art to which the invention relates.

Referring to the drawing figures, preferred embodiments of the claimed invention are illustrated. The deflooding device 21 preferably is coupled to a suction pump truck 23 having a pump P therein. Such coupling is by a flexible conduit 25 (shown in FIG. 1A schematically coupled to pump P) coupled to a discharge end of conduit 27 by coupling 29. Conduit 25 as illustrated preferably is separate from and not a part of the handle arm 31. Conduit 27 may be very short, even a stub or bayonet coupling to the suction chamber. The pump P preferably is a high powered truck-mounted suction system delivering approximately 125 cubic feet per minute as known in the industry. Alternatively, portable suction units, including ones having lesser cubic feet per minute flow rates, may be located on the job site as well. Additionally, the present invention may be utilized with higher flow rates and/or multiple conduits attached in parallel to the suction chamber, each with the flow rate (such as 125 cfm) thereby providing even greater suction in water removal.

Figure 1B:
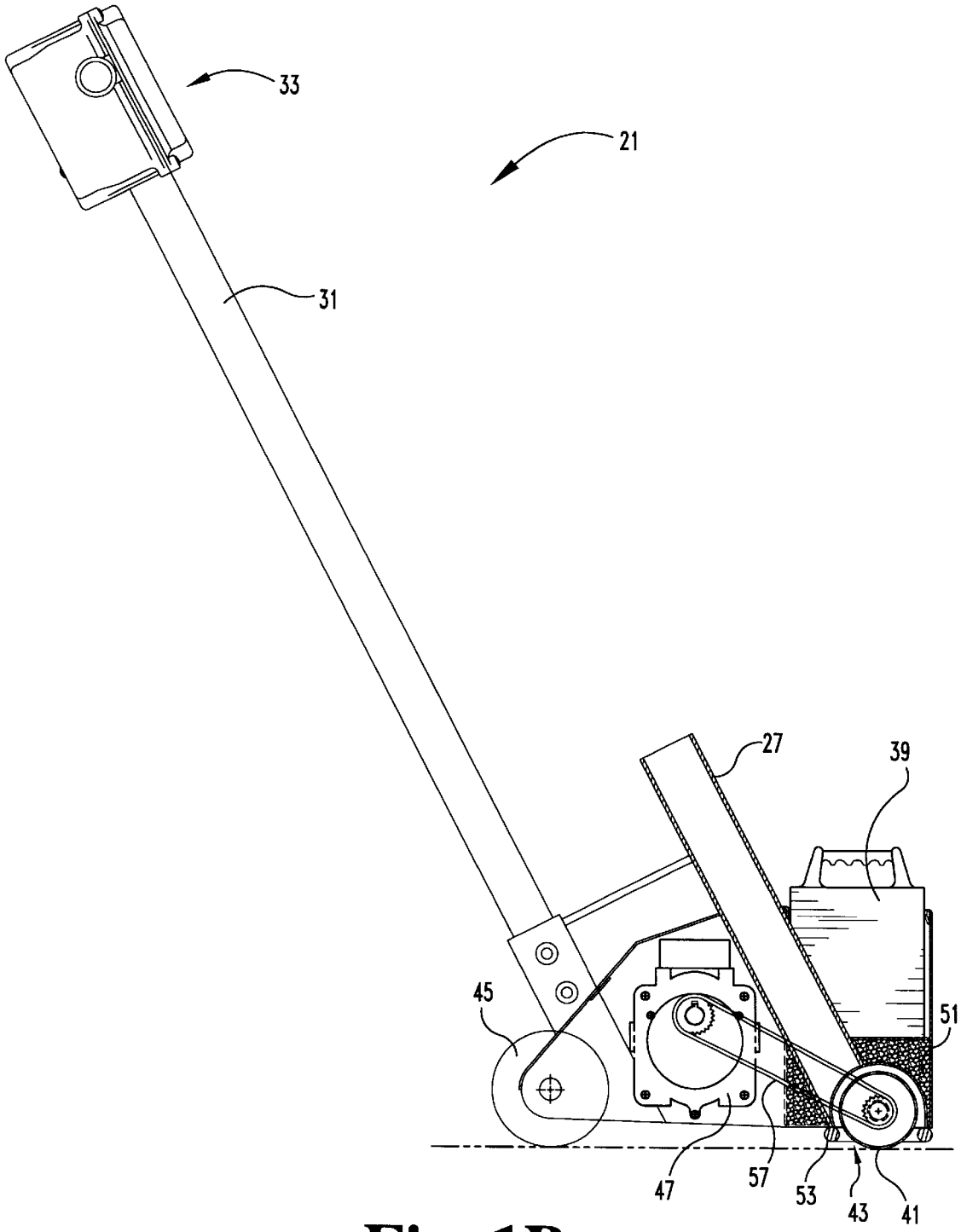
FIG. 1B is a partially cutaway side view of the device of FIG. 1A.
Figure 2A:
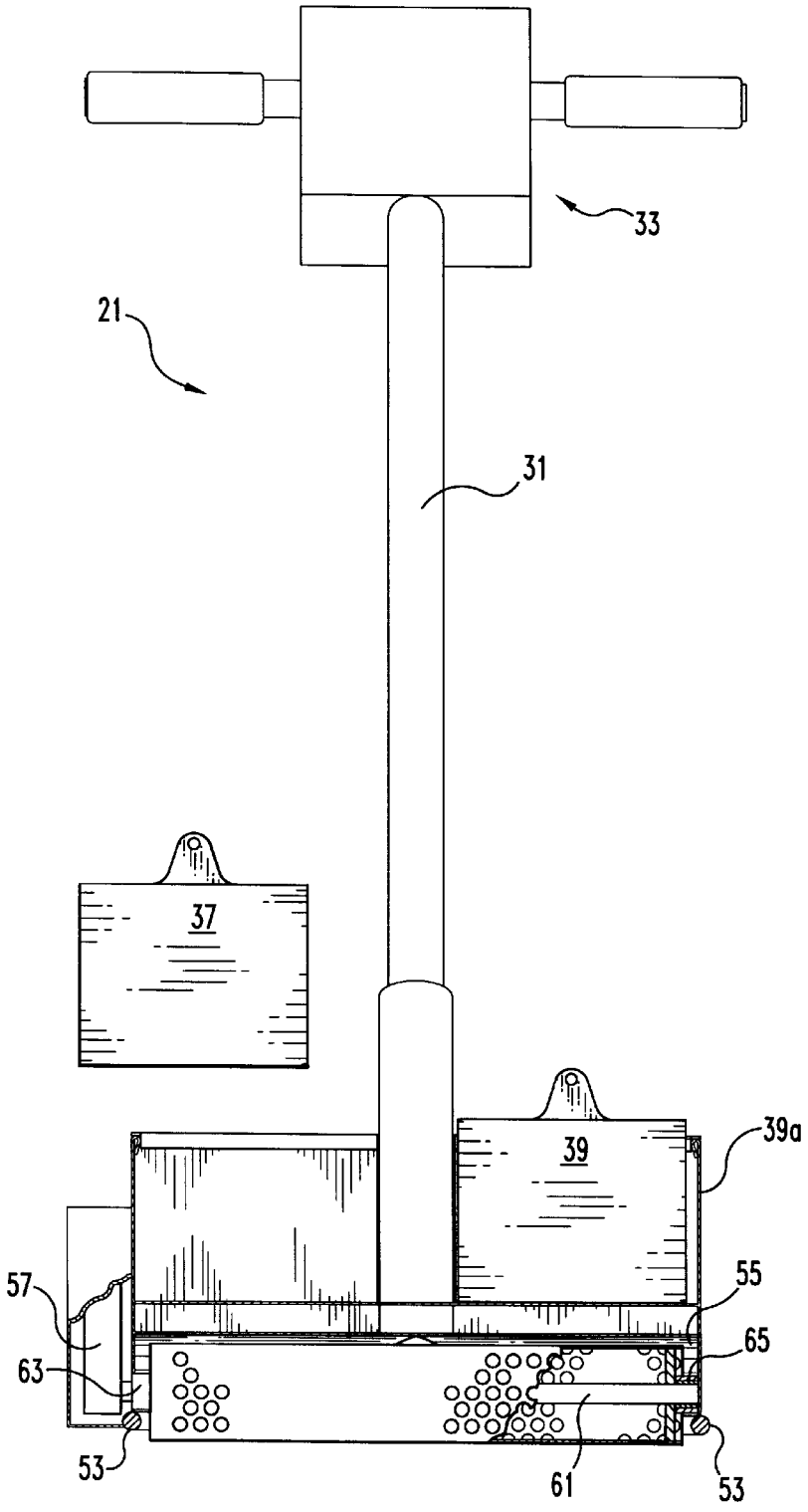
FIG. 2A is a partially cutaway front view of the device of FIG. 1A.
Figure 2B:
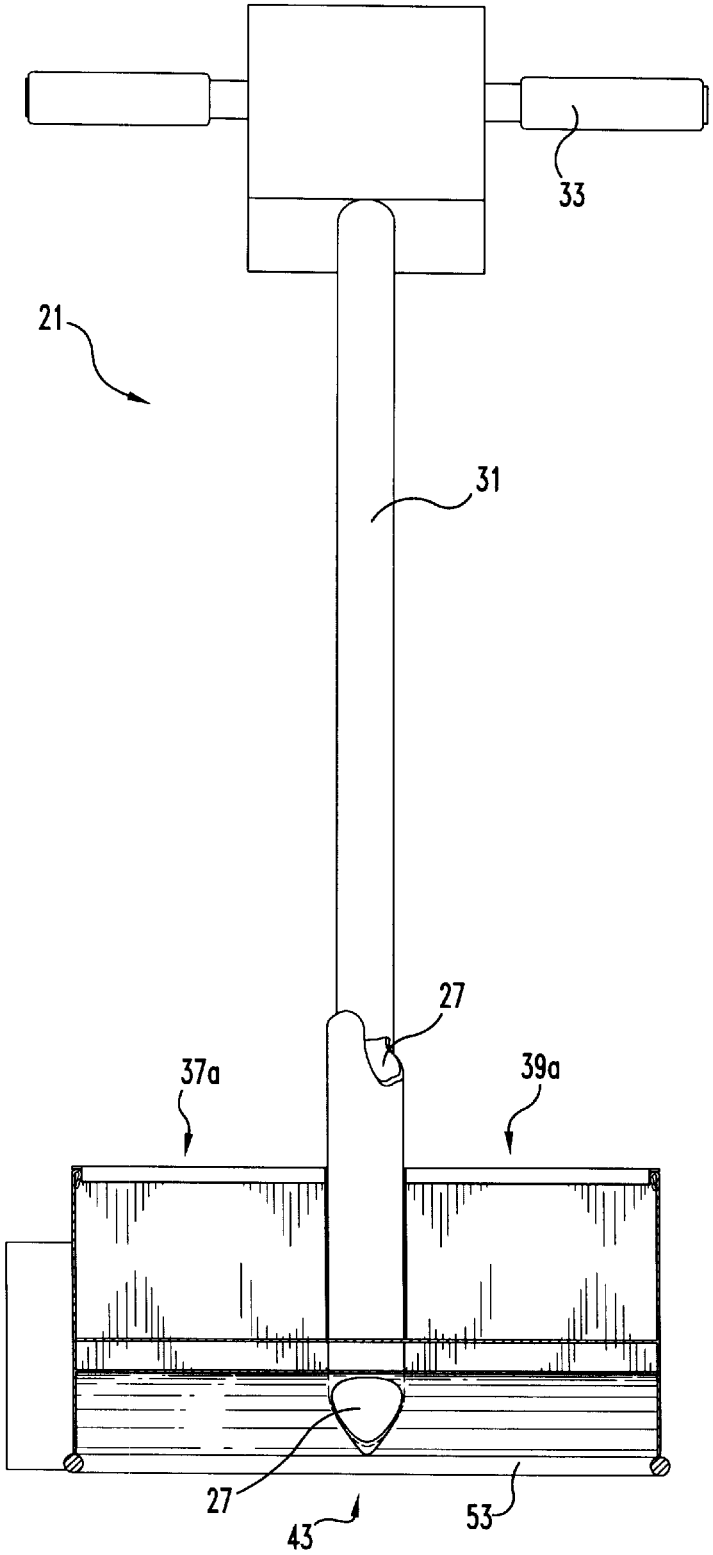
FIG. 2B is another partially cutaway front view of the device of FIG. 1A with the roller and removable weights removed.
Figure 4:
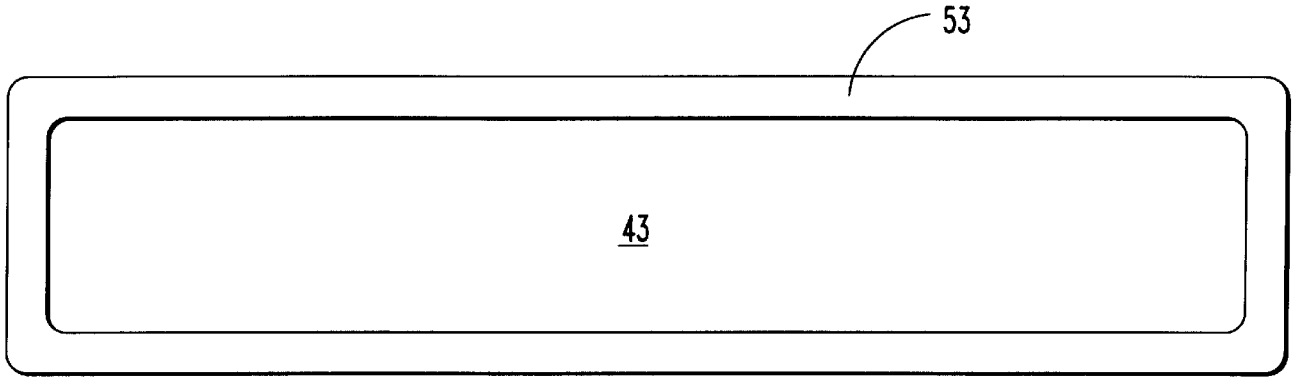
FIG. 4 is a bottom view of the frame taken in isolation.

Device 21 includes a handle arm 31 in the preferred embodiment as shown attached to a control handle 33. The arm and handle may take a variety of configurations and preferably, but not necessarily, include actuation controls for advancing and reversing the drive motor/drive system. Arm 31 is connected to a housing 35 (see FIG. 1A) with a front face 49. Optionally, housing 35 includes receptacles for weights and/or ballast. Ideally, face 49 is vertical or rearwardly inclined with roller 41 located therealong the front to facilitate water removal next to wells. As illustrated, a pair of removable weights 37 and 39 may be lowered into respective weight holders 31*a* and 39*a*. Preferably, the collective weight of these weights is in excess of 50 pounds, in excess of 75 pounds, and preferably is about 100 pounds. They are illustrated with handles to facilitate their removal, making relocation of the overall device 21 easier by breaking it down by weight components. Additionally, the weights are preferably located above, and preferably directed above, the compression element, suction roller 41 in the preferred embodiment. As illustrated, roller 41 protrudes below a downward facing opening 43 to facilitate simultaneous compression of the carpet and suction of liquid therefrom. Preferably, other wheels or rollers, such as wheel 45 located near the rear of the housing, are provided for operational stability. Such stability preferably includes maintaining suction bar, or frame 53, parallel with the carpet and the floor and level, with the front bar and rear bar thereof maintaining an equivalent seal with the carpet as it slides across the carpet. A drive motor, such as electric motor 47 (see FIG. 1B), allow for motorized advancement and reversal of the device 21. Drive motor 47 is preferably coupled to roller 41 by drive chain or belt 57, shown with a guard, and associated gears or other engagement mechanisms, coupling the gear box from the motor to the roller. For safety, it is preferred that motor 47 is low voltage (e.g. 20 to 90 volts). Alternatively, the drive means may be attached to a separate wheel mechanism, although it is preferred to be attached to the compression roller 41 with the associated weight for engaging traction on the carpet. Optional ballast 51 is provided above and around the suction chamber 55, providing further downward force on the roller. In the preferred embodiment, ballast 51 is steel, stainless steel blocks, or steel shot. A suction chamber 55 being defined and enclosed by suction chamber walls 56 is around roller 41 and coupled to conduit 27. Suction chamber 55, preferably cylindrical, in the preferred embodiment is defined in its lower most position by frame 53 which acts as a suction bar. The bar in the preferred embodiment is formed from round bar stock of about half an inch in diameter. As illustrated, its under surface which contacts the carpet is semi-cylindrical, rounded and smooth to facilitate sliding across the carpet. Downward facing opening 43 is ordinarily formed by frame 53 (see FIG. 4). Suction chamber 55 is fluid tight and in fluid tight communication by welding or other connection to the intake end of the conduit 27, thereby allowing water intake at opening 43 and discharge at the point of coupling 29.

Figure 3A:
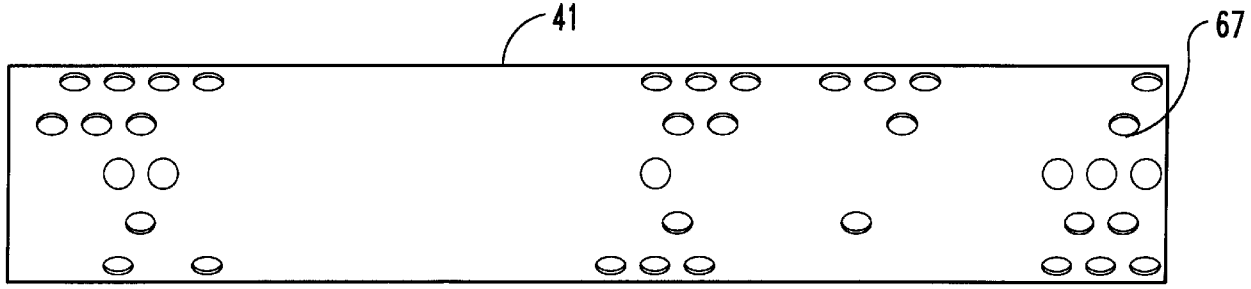
FIG. 3A is a bottom view of the roller taken in isolation.
Figure 5:
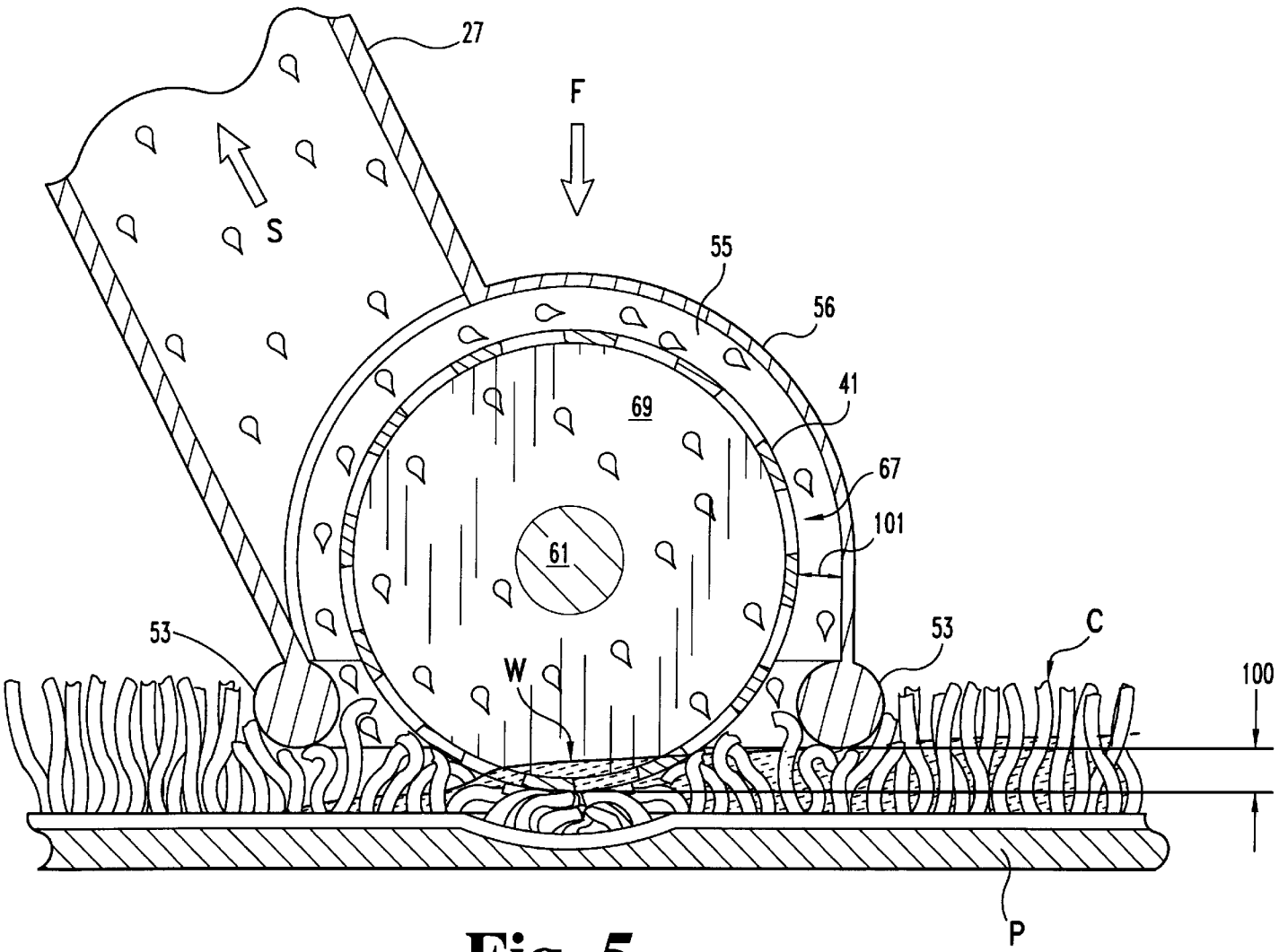
FIG. 5 is a side cutaway view showing a roller and suction chamber in engagement with flooded carpet.

Roller 41 is wider than its diameter and rotates about a horizontal axis rotation, preferably about roller axle 61 which rotates in bearing and support assembly 63 and 65. In the preferred embodiment, roller 41 has a hollow chamber 69 therein (see FIG. 5) whether or not there is a full longitudinal axle or alternatively, stub axles. In the preferred embodiment, roller 41 has an outside diameter typically ranging between 1.5 and 6 inches, and preferably approximately 2.65 inches and a width preferably of approximately 14.5 inches and is fabricated from 16 gauge stainless steal having a plurality of holes (typically 0.375 inch diameter) therein and spaced at typical spacings of 0.560 inches laterally and 0.45 inches circumferencially, resulting in a perforation density of about 50%. Naturally, these openings and dimensions may vary in size, shape and spacing. FIG. 3A for illustration purposes only has openings, such as the opening 67, shown in parts thereof, it being understood that such openings preferably cover entire surface thereof. The openings contribute to the provision of a rigid anti-wave roller which allows the roller to advance across the flooded carpet, compressing the carpet while allowing water to pass through the openings 67 into the hollow chamber 69 of the roller. In this way, the water is not squeegeed or forced forward in a substantial way. Illustrated in FIG. 5, roller 41 at its lowest most location protrudes beneath the bottom of bar 53 by distance 100. While distance 100 may vary, in the most preferred embodiment distance 100 is approximately a quarter of an inch. In this way, water W, which is flooding carpet C above pad P, is allowed to pass underneath the bottom of suction bar 53 and into suction chamber 55. This occurs nevertheless, while roller 41 compresses (via compression force F) the nap of the carpet (see the six o'clock position of roller 41 in FIG. 5). As such, air is sucked under the suction bar 53 and through the carpet nap and pad and water is sucked out by sucking action S as shown as water droplets in FIG. 5. The opening 67 in the roller are believed to enhance performance by providing an antiwave feature, namely roller 41 does not squeegee a wave of water out in front of it, thereby pushing the water away from suction chamber 55. Preferably, suction chamber 55, and its defining opening with frame 53, surround the front and back and sides of compression device 41, although it is believed that alternative arrangements including a front and/or back flume, while not preferred, would provide satisfactory results. It is believed that it is preferable to have a reasonably close spacing between the roller and the suction chamber and suction bar so as to concentrate to keep suction flow rate in a narrow area to maintain suction and velocity with such arrangement, including a suction gap along the leading edge. A solid roller is believed to produce satisfactory (although not ideal) results around bar 53 when suction bar is arranged as described and maintained level to form an elevated seal and is surrounded by suction on the front and back. In the preferred embodiment, a distance shown as 101 (see FIG. 5) is believed to be best at about one quarter of an inch, although it is believed that other reasonably narrow distances would work as well. Indeed, the interior distance in the preferred embodiment between the long spans of suction bar 53 are the same as the outer diameter of roller 41. Thus, is illustrated in FIG. 5, the tangential spacing between the outer surface of roller 41 and frame 53 is typically less than or equal one quarter of an inch. Such spacing can vary to half an inch, and believed to vary outwards of one to two inches depending on variables such as the amount of water removal desired and suction flow rated applied.

Figure 3B:
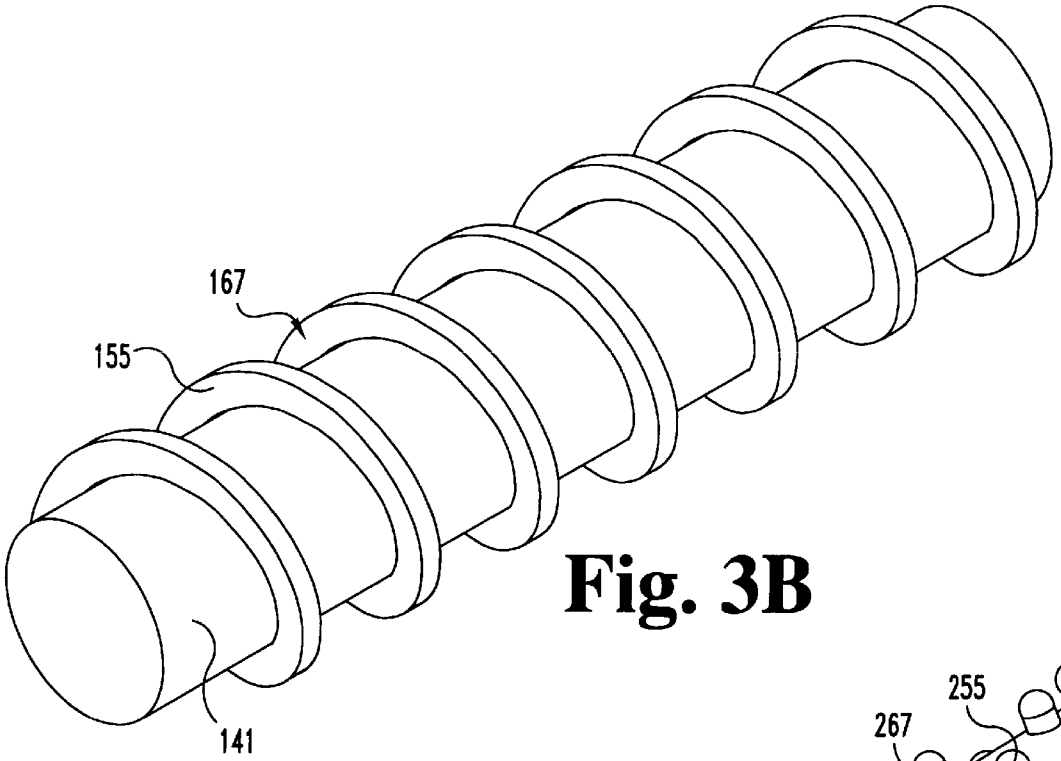
FIG. 3B is a perspective view of an alternative roller embodiment taken in isolation.
Figure 3C:
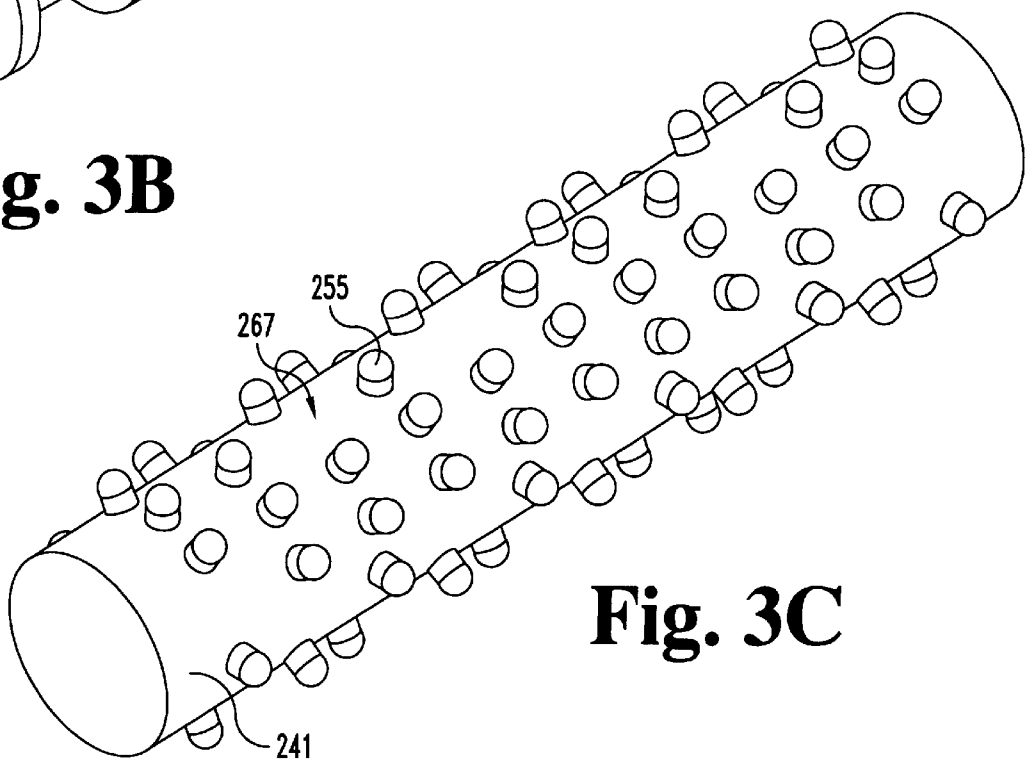
FIG. 3C is a perspective view of another alternative roller embodiment taken in isolation.

The provision of openings 67 in roller 41 also provide the additional benefit of traction as the roller is advanced along the carpet by the drive system. The self-propelled aspect of the invention is advantageous, with roller RPM of 1 to 60, and more preferably about 14 to 35 RPM, working well for water removal. Alternative embodiments of the anti-wave roller concept are disclosed in the rigid rollers shown in FIGS. 3B and 3C. In the version of FIG. 3B consists of a roller 141 having rigid protrusion 155. As shown therein, such protrusion 155 is configured like a helical worm gear and is rigid so as to allow the weights to exert downward compressive force on the carpet nap through protrusion 155 while allowing interstitial chamber 167 to reside therebetween so as to prevent the roller from acting as a wave-creating squeegee. Variations on the same include varying worm gear pitches as well as interstitial breaking of the helical worm gear portion 155. FIG. 3C discloses another anti-wave roller 241 including a plurality of rigid protuberances 255 with water chamber 267 being defined by the interstitial spaces there between. The number. shape and arrangement of such protuberances 255 can be increased and modified according to design to allow the roller to advance across the carpet and compress the carpet nap without pushing the water out in front of the suction take-up. Using alternative embodiments are contemplated with the protuberance 155 and 255 projecting beneath opening 43 defined in the suction chamber, preferrably a distance about equal to or greater than distance 100. Such protuberances also provide the carpet traction function with the carpet nap. Anti-wave carpet compression may also be achieved by a series of parallel banana-shaped bars at the bottom of opening 43 which act as skids along the bottom of the opening, imparting the downward compressive force on the carpet nap without creating a water wave in front of the suction chamber. Variations on these geometries may be included, such as a roller comprising a cylindrical cage structure, it being preferable that the components be made of stainless steal or other rigid material for durability and compressive attributes on the carpet nap.

Alternatives to the weighting system discussed above include replacing weights 37 and 39 with an operator seat mounted to the unit so as to exert force above, and preferably directly above, roller 41. Alternatively, the weights may be replaced with a hollow water chamber. Such chamber may be fillable and/or may be in line with the suction conduit path (at least temporarily) to allow priming and filling by the operator initially with the water on the job site, thereby mitigating the weight of the unit when empty for transportation purposes.

While the invention has been illustrated and described in detail in the drawings and foregoing description. the same is to be considered as illustrative and not restrictive in character. it being understood that only the preferred embodiment has been shown and described and that all changes and modifications that come within the spirit of the invention are desired to be protected.

What is claimed is:

1. A device for deflooding liquid from carpet, comprising:

a suction conduit with a discharge end and an intake end, said discharge end being couplable with a remote suction source for suction of the liquid through said conduit;

an enclosed suction chamber coupled to said intake end of said suction conduit, said suction chamber having a downward facing opening;

a wide rigid roller located within said enclosed suction chamber and rotatable around a horizontal axis of rotation, said rigid roller partially protruding below said downward facing opening with said horizontal axis of rotation positioned above said downward facing opening, wherein said roller compresses the carpet with substantial downward force to press liquid from the carpet for suction into said suction chamber;

wherein said roller has rigid carpet compressing portions and spaces therebetween to allow carpet flooding water to stand beneath the axis of rotation of said roller as suction is applied around said roller.

2. The device of claim 1 wherein said rigid roller has a hollow chamber therein and defines a generally cylindrial surface shape having a plurality of openings therethrough to allow liquid from the carpet to enter said hollow chamber as said cylinder presses liquid from said carpet.

3. The device of claim 2 and further comprising at least one weight collectively weighing at least about 75 pounds located above said roller for applying compressing weight to the carpet through said roller.

4. The device of claim 3 and further comprising a drive motor coupled to said roller to drive the roller across the carpet.

5. The device of claim 4 wherein said one or more weights are readily removable from the device by the operator.

6. The device of claim 5 wherein said suction source is in a service truck remotely located from the device and has an air flow rate at or exceeding approximately 125 cubic feet per minute.

7. The device of claim 6 wherein said downward facing opening is defined by a frame member therearound having a horizontal distance not exceeding about one inch between said roller and said frame member.

8. The device of claim 7 wherein said roller has a diameter between about one and a half inches and six inches.

9. The device of claim 1 and further comprising at least one weight collectively weighing at least about 75 pounds located above said roller for applying compressing weight to the carpet through said roller.

10. The device of claim 9 wherein said one or more weights are readily removable from the device by the operator.

11. A device for deflooding liquid from carpet, comprising:

a suction conduit with a discharge end and an intake end, said discharge end being couplable with a remote suction source for suction of the liquid through said conduit;

an enclosed suction chamber coupled to said intake end of said suction conduit, said suction chamber having a downward facing opening;

a wide rigid roller located within said enclosed suction chamber and rotatable around a horizontal axis of rotation, said rigid roller partially protruding below said downward facing opening with said horizontal axis of rotation positioned above said downward facing opening, wherein said roller compresses the carpet with substantial downward force to press liquid from the carpet for suction into said suction chamber;

and further comprising a drive motor coupled to said roller to drive the roller across the carpet.

12. A device for deflooding liquid from carpet, comprising:

a suction conduit with a discharge end and an intake end, said discharge end being couplable with a remote suction source for suction of the liquid through said conduit;

an enclosed suction chamber coupled to said intake end of said suction conduit, said suction chamber having a downward facing opening;

a wide rigid roller located within said enclosed suction chamber and rotatable around a horizontal axis of rotation, said rigid roller partially protruding below said downward facing opening with said horizontal axis of rotation positioned above said downward facing opening, wherein said roller compresses the carpet with substantial downward force to press liquid from the carpet for suction into said suction chamber;

wherein said suction source is in a service truck remotely located from the device and has an air flow rate at or exceeding approximately 125 cubic feet per minute.

13. The device of claim 1 wherein said downward facing opening is defined by a frame member therearound having a horizontal distance not exceeding about one inch between said roller and said frame member.

14. The device of claim 1 wherein said roller has a diameter between about one and a half inches and six inches.

15. A device for deflooding liquid from carpet, comprising:

A suction conduit with a discharge end and an intake end, said discharge end being couplable with a remote suction source for suction of the liquid through said conduit;

suction chamber means coupled to said suction conduct for providing suction through a downwardly facing opening in close engagement with the carpet at the bottom of said suction chamber means; and, anti-wave means adjacent said downwardly facing opening for compressing carpet beneath said anti-wave means without forcing liquid in the carpet forward of suction of said suction chamber means as the anti-wave means for compressing is advanced across the carpet, and wherein said anti-wave means includes a roller having rigid carpet compressing portions and spaces therebetween to allow carpet flooding water to stand beneath said roller.

16. The device of claim 15 and further comprising at least one weight collectively weighing at least about 75 pounds located above said roller for applying compressing weight to the carpet through said roller.

17. A device for deflooding liquid from carpet, comprising:

a suction conduit with a discharge end and an intake end, said discharge end being couplable with a remote suction source for suction of the liquid through said conduit;

suction chamber means coupled to said suction conduct for providing suction through a downwardly facing opening in close engagement with the carpet at the bottom of said suction chamber means;

anti-wave means adjacent said downwardly facing opening for compressing carpet beneath said anti-wave means without forcing liquid in the carpet forward of suction of said suction chamber means as the anti-wave means for compressing is advanced across the carpet;

and further comprising a drive motor coupled to said roller to drive the roller across the carpet.

18. The device of claim 16 and further comprising a drive motor coupled to said roller to drive the roller across the carpet.

19. A method of de-flooding water from carpet, comprising:

providing compression weight above a compression roller;

compressing a water flooded carpet with a roller having rigid protrusion areas for compressing the carpet there beneath;

sucking water flow within spaces between said rigid protrusion areas which allow water to flow within the outer circumference of said roller;

advancing said roller across a water flooded carpet; and, sucking said water in a high air flow through a suction chamber surrounding said roller.

20. A method of de-flooding water from carpet, comprising:

providing compression weight above a compression roller, said roller having rigid protrusion areas for compressing the carpet there beneath and having spaces therebetween which allow water to flow within the outer circumference of said roller;

advancing said roller across a water flooded carpet;

sucking said water in a high air flow through a suction chamber surrounding said roller;

and further including driving said roller with an electric motor at a roller speed of less than 60 RPM.

* * * * *